US011628555B1

(12) United States Patent
Williams

(10) Patent No.: US 11,628,555 B1
(45) Date of Patent: Apr. 18, 2023

(54) FLOOR MAT

(71) Applicant: Travis Williams, Manassas, VA (US)

(72) Inventor: Travis Williams, Manassas, VA (US)

( * ) Notice: Subject to any disclaimer, the term of this patent is extended or adjusted under 35 U.S.C. 154(b) by 280 days.

(21) Appl. No.: 16/841,931

(22) Filed: Apr. 7, 2020

(51) Int. Cl.

| | |
|---|---|
| ***B25H 5/00*** | (2006.01) |
| ***F21V 21/26*** | (2006.01) |
| ***F21V 33/00*** | (2006.01) |
| ***H05B 1/02*** | (2006.01) |
| *F21Y 103/10* | (2016.01) |
| *F21Y 115/10* | (2016.01) |

(52) U.S. Cl.
CPC ..... *B25H 5/00* (2013.01); *F21V 21/26* (2013.01); *F21V 33/00* (2013.01); *H05B 1/0294* (2013.01); *F21Y 2103/10* (2016.08); *F21Y 2115/10* (2016.08)

(58) Field of Classification Search
CPC ..... F21Y 115/10; H05B 1/0294; F21V 33/00; F21V 21/26; B25H 5/00
See application file for complete search history.

(56) References Cited

U.S. PATENT DOCUMENTS

| | | | | |
|---|---|---|---|---|
| 7,032,907 | B1 * | 4/2006 | Marsh | B25H 5/00 280/32.6 |
| 7,434,817 | B2 * | 10/2008 | Rush | B25H 5/00 280/32.6 |
| 8,206,002 | B1 | 6/2012 | Olson | |
| 9,068,720 | B2 | 6/2015 | Mangus | |
| 10,328,570 | B1 * | 6/2019 | O'Donnell | B25H 5/00 |
| 2002/0109991 | A1 * | 8/2002 | Alsup | F21V 33/0084 362/225 |
| 2004/0100048 | A1 * | 5/2004 | Deasy | B25H 5/00 280/32.6 |
| 2004/0100049 | A1 * | 5/2004 | Deasy | B25H 5/00 280/32.6 |
| 2011/0227303 | A1 * | 9/2011 | Gering | B25H 5/00 362/183 |
| 2017/0368677 | A1 * | 12/2017 | Rotenberg | F21V 21/08 |

FOREIGN PATENT DOCUMENTS

| | | | | |
|---|---|---|---|---|
| CA | 2666986 | A1 * | 11/2009 | B25H 5/00 |

* cited by examiner

*Primary Examiner* — Anabel Ton
(74) *Attorney, Agent, or Firm* — Sanchelima & Associates, P.A.; Christian Sanchelima; Jesus Sanchelima

(57) ABSTRACT

A floor mat including a mat assembly, a frame assembly, a case assembly and a vehicle assembly is disclosed. The mat assembly includes a mat mounted to a frame of the frame assembly. A user lays on the mat and underneath a vehicle of the vehicle assembly needing repairs. Mounted onto the frame are lights. The lights are positioned to illuminate the vehicle and regions needing repairs. The user can complete repairs unassisted and at night with the lights. Underneath of the frame are wheels for maneuvering and positioning of the mat and the user underneath of the vehicle. The mat includes heating members to provide heat and comfort to the user as they work in harsh weather conditions. The case assembly includes a case for storing and transporting the frame. The floor mat increases the safety, comfort and efficiency of the user when repairs are being completed.

10 Claims, 5 Drawing Sheets

FLOOR MAT

1. Field of the Invention

The present invention relates to a floor mat and, more particularly, to a floor mat that can be used to illuminate a surrounding area while a user is working underneath of equipment such as a vehicle.

2. Description of the Related Art

Several designs for vehicle mats have been designed in the past. None of them, however, include a mat for mechanics comprising a heated, rectangular mat having pop-up lights mounted along each edge of the mat, where the lights can rotate 360 degrees. It is difficult to work underneath of a equipment such as vehicles, especially at night. Most often, it is necessary to carry a light while working underneath of the equipment or vehicles. It becomes cumbersome to work with both hands and illuminate the working area simultaneously. Often times, there is a need to use assistance from another person to illuminate the area. Or the light is held through inconvenient means, which becomes difficult as spacing underneath of the vehicle is often limited. The present invention eliminates the need for outside assistance and facilitates working underneath of equipment such as vehicles by providing a well illuminate work area. The present invention further increases the safety of the user.

Applicant believes that a related reference corresponds to U.S. Pat. No. 8,206,002 for a modular lighted floor mat for use beneath equipment for providing hands-free light necessary to work on equipment. Applicant believes that another related reference corresponds to U.S. Pat. No. 9,068,720 for a modular work mat for a vehicle including a bas, a plurality of light sources embedded in the base, wiring connecting the light sources; wherein the wiring is operatively connectable to a power source.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a floor mat that facilitates working underneath of equipment such as vehicles.

It is another object of this invention to provide a floor mat that increases the safety of the user.

It is still another object of the present invention to provide a floor mat that helps to illuminate a surrounding work area.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
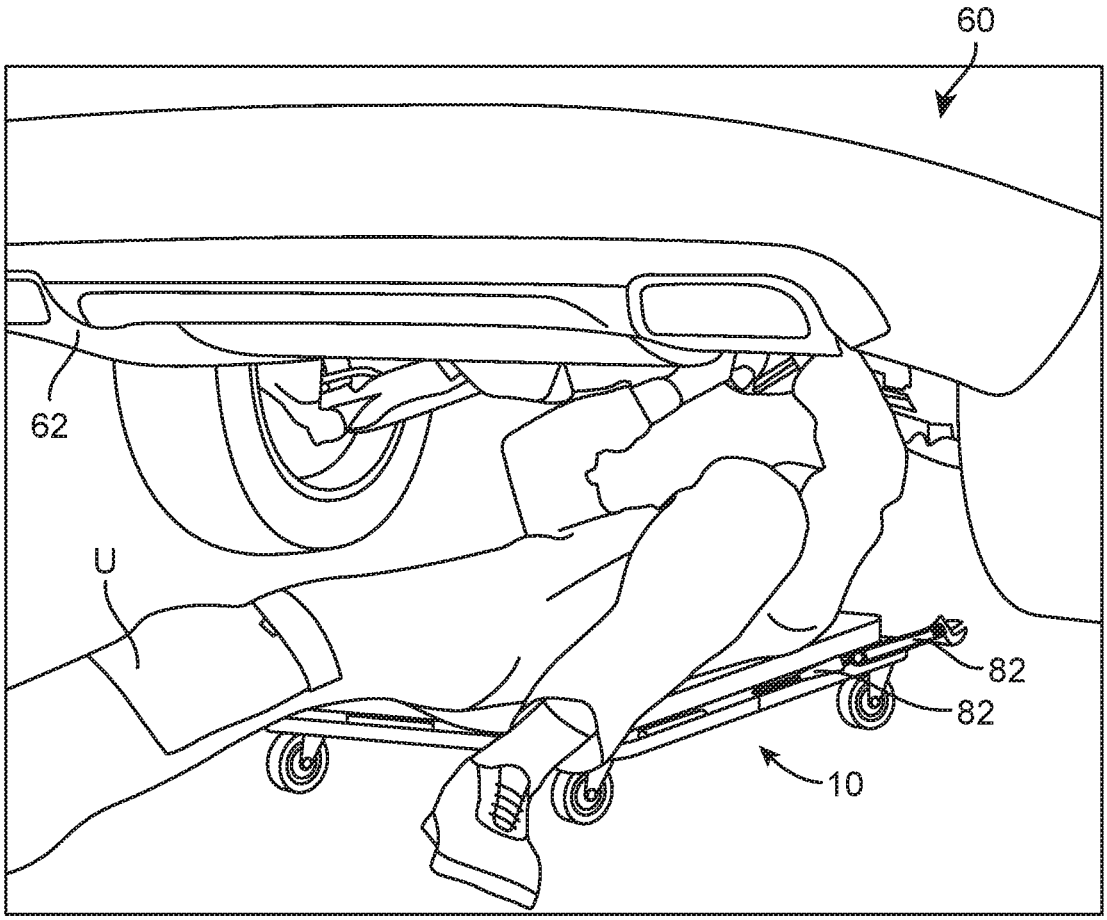
FIG. 1 represents an operational setting in which a user U is using floor mat 10 to work underneath of a vehicle 62.

Referring now to the drawings, where the present invention is generally referred to with numeral 10, it can be observed that it basically includes a mat assembly 20, a frame assembly 40, a vehicle assembly 60, and a case assembly 80.

There is often a need to work underneath of equipment such as vehicles in order to complete repairs. There is also often a need to work on equipment in the dark such as at night. Most often the user of the present invention will be a mechanic capable of making repairs to the equipment. Often times a mechanics floor mat is used for comfort and easy of maneuvering underneath of the equipment. The present invention allows ease of maneuvering underneath of the equipment such as vehicles and further providing lighting to the surrounding workspace or area. Preferably, a floor mat 10 may be used to work underneath of a vehicle 62 of vehicle assembly 60 for necessary repairs to vehicle 62, especially at night.

As best seen in FIGS. 1 through 5, floor mat 10 is depicted. Floor mat 10 may also be referred to as a mechanics mat. It can be seen that floor mat 10 includes mat assembly 20. Mat assembly 20 includes a mat 22. Mat 22 may also be referred to as a cushion. Mat 22 may preferably be soft and cushioned to provide comfort to a user U. User U may lay on mat 22 and maneuver themselves around underneath of any equipment needing repairs, as shown in FIG. 1. It can be seen that mat 22 may be rectangular and elongated in shape. Mat 22 may also include rounded corners. However, any other shape and dimensions may be suitable for mat 22. In the immediate embodiment, it can be seen that mat 22 may include a first portion 26 and a second portion 28, with first portion 26 and second portion 28 being identical. First portion 26 and second portion 28 may be adjacent to each other. However, in an alternate embodiment, mat 22 may instead be whole. In another embodiment, it may be suitable for mat 22 to be made of multiple or at least two portions. Mat 22 may be made of rubber, plastic, cotton, linen, wool, leather, nylon, canvas or other suitable materials. It may also be suitable for mat 22 to be filled with feathers, cotton, plastic, polyester, gel, wool, leather or other materials that may provide comfort to user U laying on mat 22. In one embodiment, mat 22 may be smooth on a top surface. Mat 22 may provide comfort to user U on mat 22.

Figure 4:
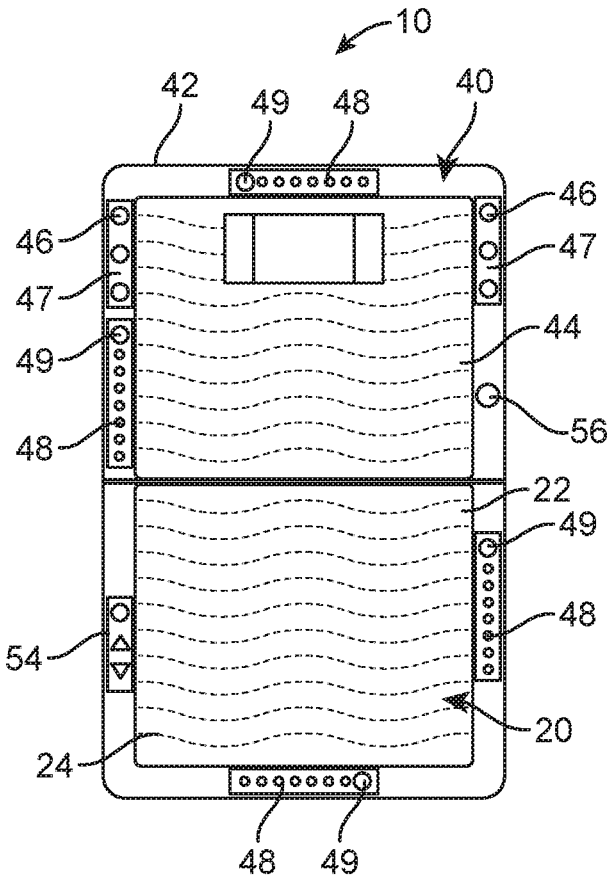
FIG. 4 is a representation of a top view of the floor mat 10 and showing heating members 24 within mat 22.
Figure 5:
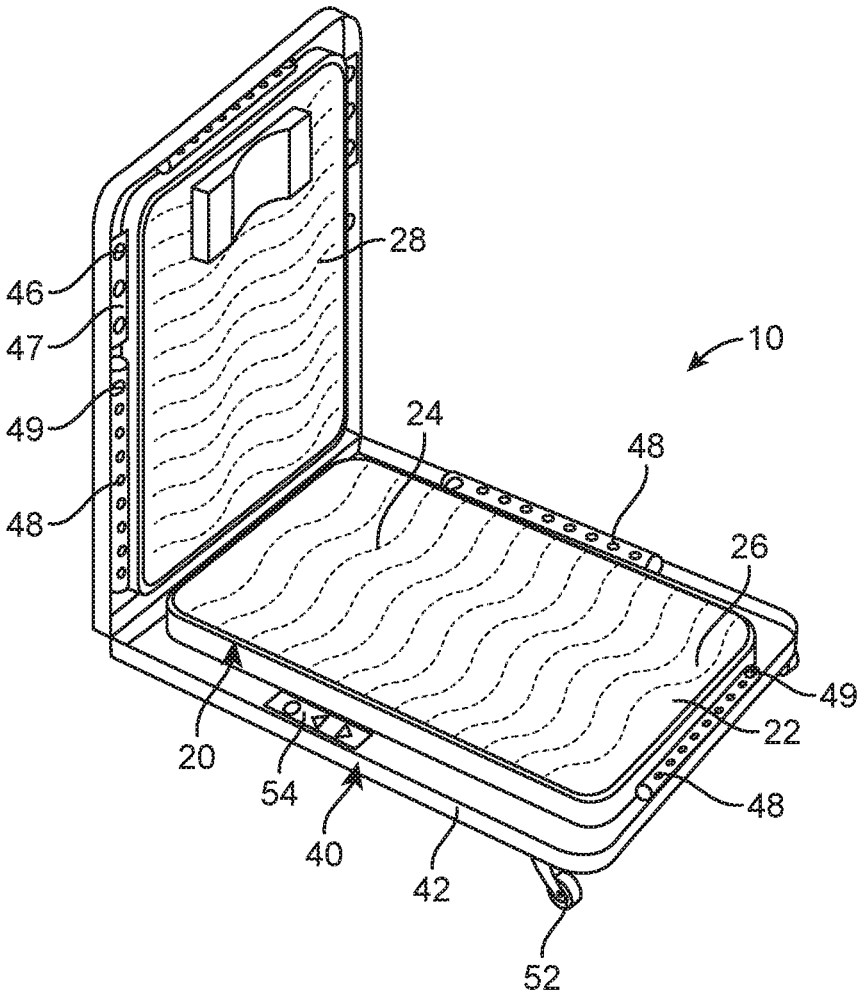
FIG. 5 shows an isometric view of floor mat 10 in a folded configuration.

Importantly, mat 22 may include heating members 24. Heating members 24 may be actuated by user U in order to be able to work under cold and harsh conditions. Heating members 24 may be actuated to emit heat and warmth to user U. Heating members 24 may provide comfort to user U to improve the efficiency and effectiveness of user U. Heating members 24 may allow user U to work during cold weather conditions which helps to increase the safety of user U. The present invention helps to have user U more readily available to work. As can be seen in FIG. 4, heating members 24 may extend horizontally across the entire width of mat 22. In an alternate embodiment, heating members 24 may extend vertically across a length of mat 22. It may also be suitable for heating members 24 to be located at predetermined locations or areas on mat 22. It may be preferable for heating members 24 to be within mat 22. In an alternate embodiment, it may be suitable for heating members 24 to be on a top surface of mat 22.

Figure 2:
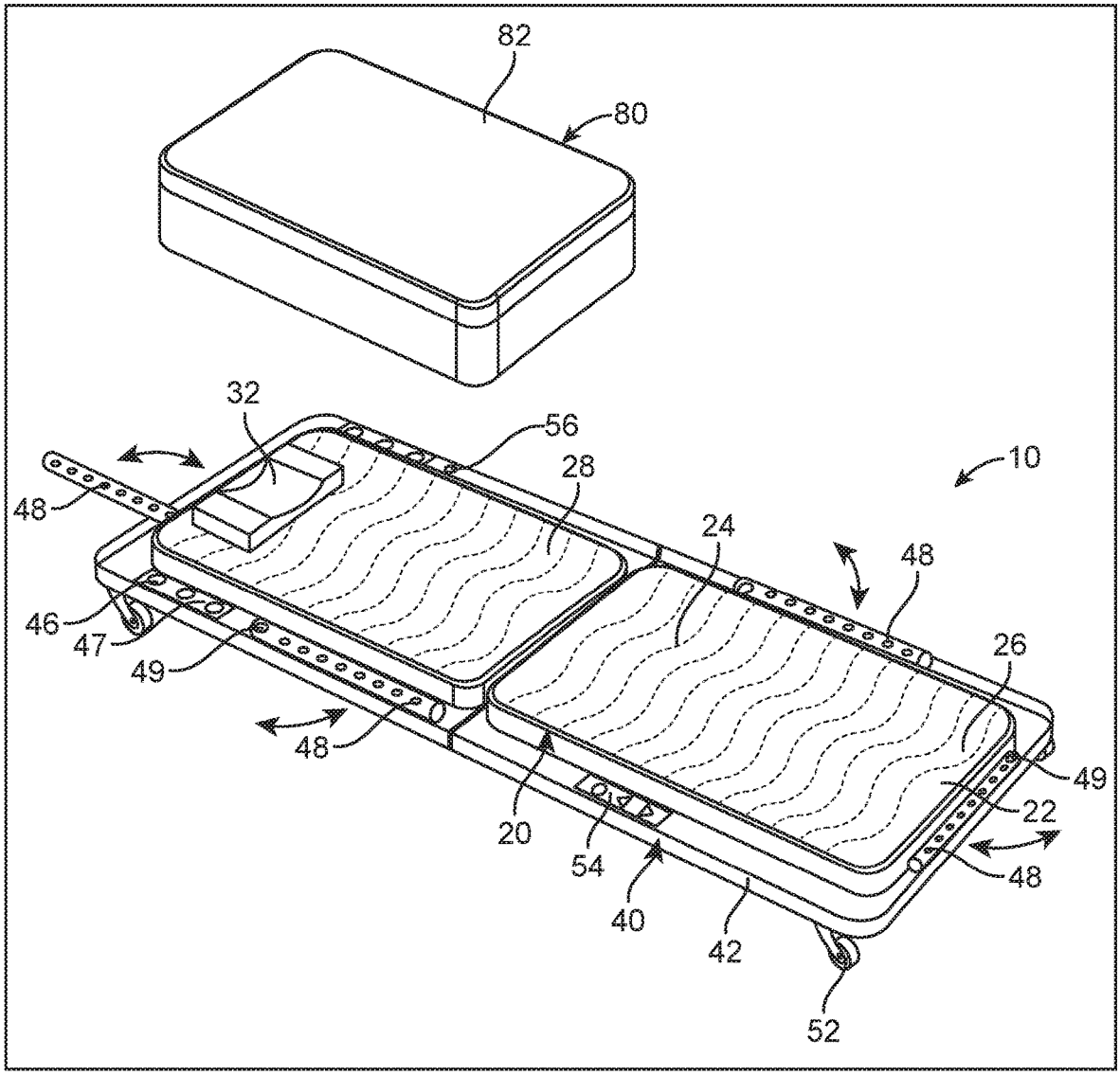
FIG. 2 shows an isometric view of the floor mat 10.

Mat assembly 20 may further include a cushion 32 as best seen in FIGS. 2 and 4. Cushion 32 may be removably mounted to either of first portion 26 or second portion 28. In the immediate embodiment, cushion 32 may be mounted to first portion 26. Preferably, cushion 32 may be used to allow user U to place their head thereon. Cushion 32 may be used to provide added comfort to user U. Cushion 32 may allow user U to remain comfortable even after prolonged periods of time. Cushion 32 may suitably be made of materials such as cotton, feathers, foam, or combinations thereof. In one embodiment, cushion 32 may be antibacterial to increase the safety of user U. In one embodiment, cushion 32 may have a substantial U shape. However, other predetermined shaped may be suitable for cushion 32.

Figure 3:
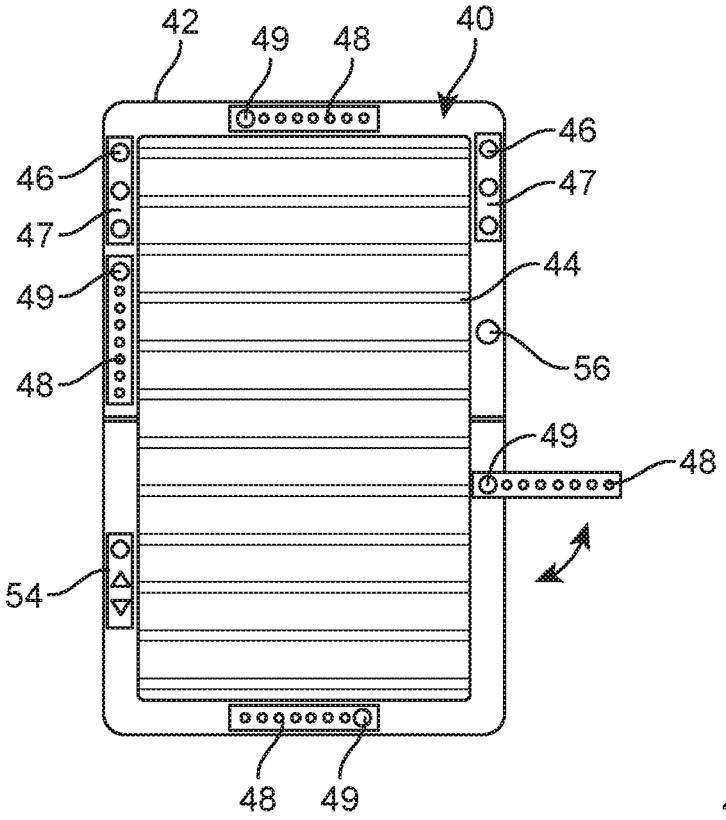
FIG. 3 illustrates a top view of the frame assembly 40.

Floor mat 10 may include frame assembly 40 as can be best seen in FIG. 3. Frame assembly 40 may provide support for mat 22. Frame assembly 40 may include a frame 42. Frame 42 may be of a shape and dimensions that cooperate with mat 22. In one embodiment, frame 42 may foldable. Preferably, frame 42 may be folded in half. It may be suitable for frame to be separated into two sections that are hingedly mounted to one another as seen in FIGS. 2-6. It can be best seen in FIG. 2, that frame 42 may extend about a perimeter of mat 22. Mat 22 may be of dimensions that cooperate with fitting within a perimeter of frame 42 once mat 22 is mounted to frame 42. In one embodiment, it may be suitable for mat 22 and frame 42 to have a spacing between each other. Frame 42 may also include rounded corners. Frame 42 may preferably be lightweight for ease of movability and maneuvering. It may be suitable for frame 42 to be made of aluminum, plastic, metal, stainless steel, rubber or other similar materials. It may be suitable for frame to be hollow or solid.

Frame 42 may include support members 44 which may extend about a width of frame 42. It is to be understood that support members 44 extend within the perimeter of frame 42. Support members 44 may extend partially across the width of frame 42. Support members 44 may extend horizontally across frame 42 as best seen in FIG. 3. In an alternate embodiment, it may be suitable for support members 44 to extend vertically across frame 42. Support members 44 provide support for mat 22 to be mounted to frame 42. Support members 44 may also provide support to user U to ensure that the present invention can support the weight of user U. In one embodiment, support members 44 may be rectangular in shape. However, it may also be suitable for support members 44 to be of other shapes as well. Support members 44 may be tubing that extends across frame 42 for support.

Mounted onto frame 42 may be magnets 46. Magnets 46 may be mounted at predetermined locations on frame 42 and about the perimeter of frame 42. It may be suitable for magnets 46 to be grouped together at predetermined locations, as can be best seen in FIG. 1 through 5. It may be possible for magnets 46 to be grouped together on a magnet holder 47. Magnets 46 may be evenly spaced apart on magnet holder 47. It may be suitable for the present invention to include at least one of magnet holder 47. It may be suitable for multiple of magnet holder 47 to be parallel to each other. Magnet holder 47 may be beneath said magnets 46. Magnets 46 may be used to temporality secure tools 92 to frame 42 in order to maintain tools 92 readily available for user U. It is to be understood that it may be suitable for the present invention to include at least one of magnets 46.

Importantly, frame assembly 40 may include lights 48. Lights 48 may preferably be mounted on frame 42. Lights 48 may be located at predetermined areas on frame 42. Lights 48 may be LED lights. Lights 48 may emit light upwardly. Lights 48 help to illuminate the surrounding area to allow user U to work comfortably and safely. Preferably, lights 48 may be pivotally mounted to frame 42. Pivots 49 may be used to allow lights 48 to swivel away from or towards frame 42. Lights 48 may be positioned at predetermined angles relative to frame 42. In one embodiment, lights 48 may swivel 360 degrees about each of pivots 49. Pivots 49 permit positioning lights 48 more accurately as needed by user U. This helps user U to be able to repair equipment or vehicle 62 unassisted. Lights 48 eliminate the need for user U to hold lighting underneath of vehicle 62 through unconventional means such as with the mouth of user U. Lights 48 make it possible so that user U is able to repair vehicle 62 even at night. Lights 48 may be mounted about the perimeter of frame 42. Lights 48 mounted on opposite ends or sides of frame 42 may be parallel to each other when in the stored configuration. Lights 48 may be entirely and directly above frame 42 when lights 48 are in the stored configuration. Lights 48 may be in an elongated shaped, preferably. However, it is to be understood that lights 48 may be of predetermined dimensions and shape. Lights 48 may each be of different dimensions. Meaning that some of lights 48 mounted on frame 42 may be larger than other of lights 48 mounted on frame 42. It can be seen that in the preferred embodiment, lights 48 on lateral sides of frame 42 may be larger than lights 48 mounted on the top and bottom peripheral sides of frame 42. In one embodiment, each of lights 48 may have same dimensions. In an alternate embodiment, lights 48 may be pop out lights.

Mounted underneath of frame 42 may be wheels 52. Wheels 52 may facilitate maneuvering and navigating of floor mat 10 during usage. While underneath of equipment or vehicle 62, user U may have limited spacing to move and position floor mat 10. Wheels 52 may help user U to position floor mat 10 more easily underneath of vehicle 62. Wheels 52 may swivel to move floor mat 10 in any predetermined direction. User U may need to access when side of vehicle 62 for repairs and then need to roll over to a different side of vehicle 62 for additional repairs. Wheels 52 facilitate that transition. Wheels 52 may preferably be underneath each of the corners of frame 42. It may be suitable for the present invention to include at least one of wheels 52. Preferably, wheels 52 may be removably mounted to frame 42. Wheels 52 may be removed to allow for floor mat 10 to remain stationary. Some users may not find in necessary to reposition themselves once underneath of vehicle 62.

Mounted onto frame 42 may also be controls 54. Controls 54 may be buttons or switches. Controls 54 may be interconnected with heating members 24. Controls 54 may be operated to actuate and control heating members 24. One of controls 54 may power on or off heating members 24. Another of controls 54 may be used to raise the temperature or heat emitted by heating members 24. Yet another of controls 54 may be actuated to lower the temperature or heat emitted by heating members 24. Controls 54 help user U to customize the heated features of the present invention in order for ultimate comfort to be achieved. Controls 54 may include a power button, a temperature raising button and a temperature lowering button.

Additionally, mounted onto frame 42 may be a switch 56. Switch 56 may preferably be used to control and activate lights 48. As such, lights 48 and switch 56 may be interconnected by electrical wires or the like as known in the art. Switch 56 may be mounted on a predetermined location on frame 42. In one embodiment, switch 56 may be a press switch. Switch 56 may be actuated once to turn on one of lights 48. Switch 56 may be successively actuated twice to turn on two of lights 48. Switch 56 may be successively actuated three times to turn on three of lights 48. Switch 56 may be successively actuated four times to turn on four of lights 48. Switch 56 may be actuated more than four times to turn off lights 48. It is to be understood that switch 56 and the number of successive actuations may correspond with the number of lights 48.

It is to be understood that floor mat 10 may include batteries to power heating members 24 or lights 48. The batteries may be rechargeable. However, it may also be suitable for floor mat 10 to include a power cord mounted thereto. The power cord may be connected to a power source to provide sufficient power to heating members 24 and lights 48 to function as necessary.

Figure 6:
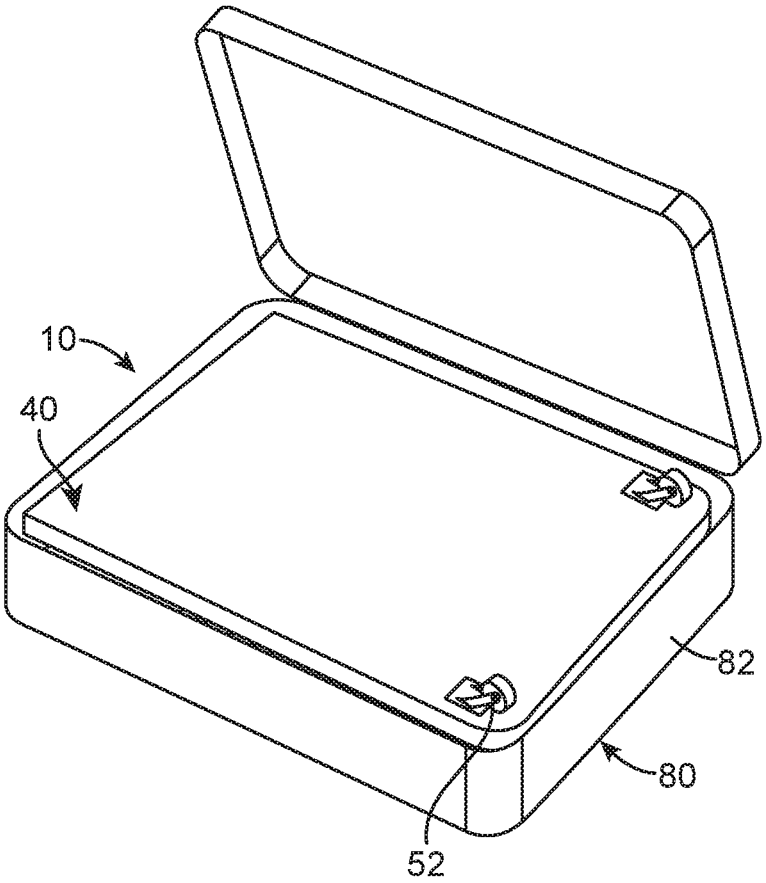
FIG. 6 illustrates floor mat 10 in a stored configuration within a case assembly 80.

Case assembly 80 as best seen in FIGS. 2 and 6, may include a case 82. Case 82 may be used for ease of storing or transporting the present invention. Case 82 may include a lid for covering and securing the present invention within case 82. In one embodiment, case 82 may include handle that assists user U in moving case 82 about. Case 82 may be made of a rigid material that protects floor mat 10 held therein. Case 82 may be of dimensions that cooperate with floor mat 10 fitting securely therein.

The present invention allows user U to work underneath of equipment or vehicle 62 even at night. The present invention further includes lights 48 which may allow user U to work comfortably and unassisted. Lights 48 may swivel to allow for optimal positioning of lights 48 as needed by user U. Further, the present invention may be easily positioned for ease of maneuvering user U while underneath of vehicle 62 with wheels 52. The present invention allows user U to position themselves in an optimal position for optimal viewing of the workspace needing repairs. The present invention allows for user U to work more safely, comfortably, and efficiently.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a floor mat, comprising:

a) a mat assembly including a mat which has a first portion and a second portion having rectangular body with rounded corners each one, said mat having heating members;

b) a frame assembly including a frame, said mat having a rectangular body with rounded corners mounted completely within a perimeter of said frame, said frame further including lights mounted at predetermined locations along the top surface of said perimeter, said lights rotatable outwardly and away from said frame configured to expand a predetermined illumination area, said frame assembly includes magnets mounted about the top surface covering the perimeter of said frame at predetermined locations to attach a tool in multiple portions of said frame when required, said magnets being on opposite sides of said frame, said magnets being parallel to each other, said magnets are grouped together on at least one magnet holder having a rectangular body, said magnets being evenly spaced apart on said at least one magnet holder, said at least one magnet holder being beneath of said magnets and coplanar to another of said at least one magnet holder, said at least one magnet holder being parallel to another of said at least one magnet holder on said frame, said at least one magnet holder is attached to a proximal side of the mat being coplanar to each other, said lights are coplanar to the perimeter covering each top side of said mat; and c) a case assembly including a case with a shape that conforms said frame and is used to store and transport said frame therein when folding said frame.

2. The system of claim 1, wherein said first portion and said second portion being coplanar and in abutting contact at width sides to each other, said first portion being beneath of said second portion.

3. The system of claim 1, wherein said heating members extend horizontally across an entire width of said mat.

4. The system of claim 1, wherein said frame includes support members, said support members being completely within the square perimeter of said frame, said support members extending horizontally and partially across a width of said frame.

5. The system of claim 1, wherein said lights rotate on said frame with a pivot, said lights rotatable 360 degrees about said pivot.

6. The system of claim 1, wherein said frame assembly further includes controls mounted onto said frame, said controls allowing actuating of said heating members, said controls further raise or lower the heat emitted by said heating members, said controls being coplanar and adjacent to said mat.

7. The system of claim 1, wherein said mat is rounded rectangular shaped.

8. The system of claim 1, wherein a cushion is removably mounted onto said first portion or said second portion.

9. The system of claim 1, wherein a switch is mounted onto said frame, said switch being engaged to actuate said lights in a successive configuration wherein the times the user actuates the switch correspond to the number of lights that would turn on.

10. The system of claim 1, wherein said lights have a stored configuration being entirely and directly above of said perimeter of said frame, said lights on opposite sides of said frame being coplanar regarding to said frame.

* * * * *